United States Patent [19]

Kobayashi et al.

[11] Patent Number: 4,749,291

[45] Date of Patent: Jun. 7, 1988

[54] INKING SYSTEM FOR WIRE DOT MATRIX PRINTER

[75] Inventors: Masaru Kobayashi, Funabashi; Hisao Fukui, Soka; Tetuo Taguchi, Kawaguchi; Takashi Ishikawa, Toride, all of Japan

[73] Assignee: Pentel Kabushiki Kaisha, Tokyo, Japan

[21] Appl. No.: 910,874

[22] Filed: Sep. 23, 1986

[51] Int. Cl.[4] ..... B41J 27/04

[52] U.S. Cl. ..... 400/124; 400/471.1

[58] Field of Search ..... 400/124, 470, 471, 471.1; 101/93.05; 346/140 A

[56] References Cited

U.S. PATENT DOCUMENTS

| | | | |
|---|---|---|---|
| 3,900,094 | 8/1975 | Larsen | 101/93.05 X |
| 4,400,102 | 8/1983 | Shiurila | 400/471.1 X |
| 4,643,599 | 2/1987 | Taguchi | 400/470 X |
| 4,646,111 | 2/1987 | Shimosato | 400/124 X |

FOREIGN PATENT DOCUMENTS

| | | | |
|---|---|---|---|
| 116466 | 6/1985 | Japan | 400/124 |
| 245560 | 12/1985 | Japan | 400/124 |
| 245562 | 12/1985 | Japan | 400/124 |
| 264262 | 12/1985 | Japan | 400/124 |

*Primary Examiner*—Paul T. Sewell

*Attorney, Agent, or Firm*—Bruce L. Adams; Van C. Wilks

[57] ABSTRACT

An inking system comprising an ink vessel removably mounted on a nose portion of a wire dot matrix printer. The ink vessel is stationarily connected to a capillary path member for transferring ink reserved within the ink vessel to the rear surface of a bearing plate which is disposed at the front end of the nose portion of the printer for supporting printing ends of printing wires. The ink vessel accommodates therein an ink absorbent member such as synthetic fibers in contact with the upper end portion of the capillary path member, and reserves ink in an absorbed state in the ink absorbent member. At least one slit is formed in the lower end portion of the capillary path member such that the slit permits a group of the printing wires to extend therethrough without causing any forced contact between the respective printing wire and the lower end portion. The lower end portion wetted with the ink is forcedly contacted with the rear surface of the bearing plate by pressing means disposed within the nose portion. The ink is transferred to each of the printing wires via the bearing plate. The ink supply to the printing wires during the printing operation can be made speedily and appropriately by adjusting the bulk factor of the capillary path member within the range less than that of the ink absorbent member.

31 Claims, 3 Drawing Sheets

INKING SYSTEM FOR WIRE DOT MATRIX PRINTER

BACKGROUND OF THE INVENTION

1. Field of the Invention

The present invention relates to a wire dot matrix printer head and, more particularly, relates to an inking system for supplying liquid ink directly to printing wires.

2. Description of the Prior Art

Generally, in a wire dot matrix printer requiring no ink ribbon, an ink absorbent member is arranged in a printer head thereof so as to come into direct contact with each of printing wires to thereby supply ink to the printing wires. The ink absorbent member is supplied with ink from an ink reservoir vessel via a capillary path member or a pipe. The wire dot matrix printers of this type are disclosed in, for example, U.S. Pat. Nos. 4,194,846, 4,279,519 and 4,353,654, and Japanese Patent Unexamined Publication Nos. 56-11272 and 58-124671. A wire dot matrix printer of another type in which, instead of such an ink absorbent member fixed in a printer head, an ink reservoir vessel having a projecting cloth-fiber cable wet with ink, projected therefrom and fixed thereon is removably mounted on the printer head so as to urge a projection end surface of the cloth-fiber cable against one-side surfaces of a plurality of vertically aligned printing wires, is disclosed in U.S. Pat. No. 4,445,127.

In the wire dot matrix printers of those types as described above, however, the forced contact portion between the ink absorbent member or cloth-fiber cable and the respective printing wires is not free from abrasion or deterioration by the reciprocating motion of the printing wires. Accordingly, sufficient inking to all the printing wires over a long period of time cannot be ensured. Furthermore, a friction load due to the forced contact is added to the printing wires in motion, and the load may varies for every printing wire. Consequently, smudgy or blurred printing is apt to occur.

3. Applications of Related Techniques Filed by the Present Inventors

In order to eliminate the above-mentioned defects in the prior art, T. Taguchi and T. Ishikawa of the inventors of this application invented techniques related to an inking system for a wire matrix printer in which ink absorbed in an ink absorbent member can be uniformly and sufficiently transferred to each of printing wires without forcedly urging the ink absorbent member against the respective printing wires. The invented techniques were applied for Japanese utility model registrations on July 31, 1984. The applications were laid open on Feb. 26, 1986 bearing Utility Model Unexamined Publication Nos. 61-31834 and 61-31835. Further, the invented techniques are disclosed in U.S. patent application Ser. No. 760,599 filed in the United States on July 30, 1985 claiming priority on the basis of the above-mentioned Japanese utility model applications and assigned to the assignee of this application. This inking system is featured in that a gap large enough to avoid friction is provided between each of or the whole of a group of printing wires and an ink absorbent member surrounding the printing wires and that the ink absorbent member is arranged to be urged by springs or the like against the rear surface of a bearing plate provided on the front end surface of a printer head for supporting the printing wires, so that ink absorbed in the ink absorbent member returns to its original liquid state on the rear surface of the bearing plate and the liquid ink is transferred to printing ends of the respective printing wires through holes formed in the bearing plate for slidably supporting the respective printing wires. In this inking system, the ink absorbent member is fixedly accommodated in an ink chamber provided at a nose portion of the printer head. An ink vessel for storing ink therein is adapted to be removably mounted on the upper portion of the ink chamber, and a capillary path member extending from the inside of the ink vessel downward to the lower outside of the same through the bottom thereof. The ink vessel is mounted at the upper portion of the ink chamber so that the projecting lower end surface of the capillary path member is made to be in forced contact with the upper surface of the ink absorbent member through an opening formed in the upper surface of the ink chamber. Thus, the ink can be supplied from the ink vessel to the ink absorbent member. Owing to the above-mentioned arrangement and functions, inking to the printing wires can be made surely without causing any deterioration or any abrasion in the ink absorbent member and without applying any additional frictional load to the printing wires in motion.

Further, M. Kobayashi, H. Fukui and T. Taguchi of the inventors of this application invented a technique as to an inking system for a wire dot matrix printer having an arrangement and functions which can be summarized as follows. This technique was applied for a Japanese utility model registration on July 31, 1984 and was laid open on Feb. 26, 1986 bearing Japanese Utility Model Unexamined Publication No. 61-31833. The inking system according to this technique is arranged such that a cartridge containing printing ink therein is removably mounted on the upper surface of a nose portion of a printer head. A capillary path member providing an ink path extending from the inside of the cartridge downward to the outside through the bottom of the same is integrally formed in the cartridge. A slit is formed at the projecting lower end portion of the capillary path member, the slit being opened at its lower portion to permit a group of printing wires to extend therethrough. An opening is formed in the upper surface of the nose portion for inserting the lower end portion of the capillary path member into the inside of the nose portion, so that the inner surface of the slit is made to be in contact with or to be close to each of the printing wires in the nose portion when the cartridge is mounted onto the nose portion. In such an arrangement, ink absorbed in the lower end portion of the capillary path member can be transferred to each of the printing wires through the direct contact between the lower end portion of the capillary path member and the respective printing wires or through the contact between the lower end portion of the capillary path member and the rear surface of a bearing plate fixed on the front end of the nose portion for supporting the printing wires.

In those two types of inking systems applied for utility model registration, problems to be improved were found as the results of a great deal of experiences of use thereafter. In the inking system disclosed in the above-mentioned U.S. patent application Ser. No. 760,599, the ink absorbent member is provided within the nose portion and fixed thereto. Therefore, when a printing operation is suspended for a long time, ink sludge is accumulated in the voids inside the ink absorbent member due to evaporization of ink contained in the ink absorbent member to thereby make the ink absorbent member clogged to bring a hindrance to absorption of ink into the absorbent member and to fluidity of ink inside the same. Furthermore, replacement of the ink absorbent member is not easy. These problems are the same as those in the prior art inking system in which the ink absorbent member is disposed within the nose portion and fixed thereto.

The inking system as disclosed in Japanese Utility Model Unexamined Publication No. 61-31833 is excellent in that the above-mentioned problems are solved in the system. This inking system is different from the inking system as disclosed in U.S. Pat. No. 4,445,127 in that the ink cartridge is filled with a fiber for reserving ink in an absorbed state, so that the lower end portion of the capillary path member can therefore be approached to the group of printing wires from just above, and ink supply from the capillary path member to the respective printing wires is effected from the opposite sides of the respective printing wires. In this inking system, however, the lower end portion of the capillary path member is deteriorated and worn out at a portion brought into forced contact with the printing wires. If the width of the slit permitting the printing wire group to extend therethrough is enlarged to avoid this defect, it cannot be ensured to supply ink completely to all the printing wires.

SUMMARY OF THE INVENTION

It is therefore a first object of the present invention to provide an improved inking system in which the above-mentioned disadvantages in the prior art are eliminated and the above-discussed problems in the inking systems related to the inventors of this application are solved.

It is a second object of the present invention to provide an inking system which comprises means for surely and properly supplying each of printing wires with ink reserved in an ink vessel in response to the consumption of ink during the printing operation.

The present invention provides an improvement in an inking system for a wire matrix printer. The system includes a plurality of printing wires operatively connected at their respective one ends to an actuator unit; a housing carried on a front end of the actuator unit for accommodating the printing wires therein; a bearing plate fixed to a front end of the housing for slidably supporting the other ends of the printing wires through holes formed in the bearing plate; an ink vessel for reserving ink; a capillary path member for providing an ink path, the capillary path member having an upper end portion extended up into an inside of the ink vessel and a lower end portion extended down to an outside of the ink vessel; and connection means for removably mounting the ink vessel on the housing.

The improved inking system according to the invention is featured as follows.

The ink vessel accommodates therein an ink absorbent member impregnated with ink, so that the capillary path member is wetted with ink through contact between the upper end portion of the capillary path member and the ink absorbent member, and the lower end portion of the capillary path member is downwardly projected out of the ink vessel through a hole formed in a lower portion of the ink vessel.

The housing has an opening formed in its upper surface for inserting the lower portion of the capillary path member into the housing, and pressing means is fixed within the housing and formed with a cam surface for urging the lower end portion of the capillary path member against a rear surface of the bearing plate so as to bring the lower end portion of the capillary path member into forced contact with the rear surface of the bearing plate to transfer ink absorbed in the lower end portion of the capillary path member to the other ends of the printing wires through the rear surface of the bearing plate and the bores of the bearing plate continuously.

The lower end portion of the capillary path member has at least one slit open at its lower end for permitting the plurality of printing wires to extend through the slit. The slit has a sectional size which is selected to be large enough to surely keep the printing wires substantially free from forced contact with the lower end portion of the capillary path member.

The connection means is adapted to removably mount the ink vessel onto the upper surface of the housing such that the slit is disposed in a position where the slit surrounds the plurality of printing wires while substantially preventing the forced contact between the printing wires and the lower end portion of the capillary path member.

As is apparent from the above-described construction, the present invention is accomplished on the basis of the technique disclosed in Japanese Utility Model Unexamined Publication No. 61-31833 in combination with the ink supply means for supplying the printing wires with ink as disclosed in U.S. patent application Ser. No. 760,599. Further, a preferred embodiment of the present invention is featured in that the inking system includes specific means for surely and properly supplying ink reserved in the ink vessel onto the rear surface of the bearing plate in response to the consumption of ink during the printing operation.

According to a preferred embodiment of the present invention, ink within the ink vessel is maintained in such a state that it is absorbed in the ink absorbent member constituted by a fiber having a wettability with ink. This is a measure to counter the uncontrollable outflow of ink through the capillary path member during suspension of printing operation in the case where ink is kept within the vessel in the form of original liquid state or in other words in the form of so-called free liquid, the outflow of ink causing contamination of the inside of the nose portion or a surface to be printed or other disadvantages. The capillary path member is formed with a large number of capillary paths in the inside thereof to absorb ink and transmit the same, and preferably, constituted by a molding formed by partially adhering single fibers wettable with ink to each other with a resin, the molding having a bulk factor lower than that of the fiber filled in the ink vessel.

According to a preferred embodiment of the present invention, the pressing means is constituted by protrusions projected toward the bearing plate and fixed within the housing, so that the means is simple and practical in structure. Any material may be used for the protrusions as long as the material has a hardness large enough to compress the lower end portion of the capillary path member forcedly inserted between the bearing plate and the projections.

Preferably, an air hole is formed in an upper portion of the ink vessel. This is for the necessity of keeping the pressure of air within the ink vessel equal to the outside atmospheric pressure all times in order to supply ink to the printing wires through the capillary path member automatically, continuously and properly during the printing operation.

More preferably, in order to prevent the evaporation of ink on the bearing plate during suspension of the printing operation, there is provided cover means rotatably mounted at a front end portion of the housing so as to temporarily cover the front surface of the bearing plate.

In the inking system of the present invention, the subject of application thereof is not limited to a single group of vertically aligned printing wires. For example, in the case where a large number of printing wires are separated into two groups aligned in two lines at a certain distance as disclosed in U.S. Pat. No. 3,900,094, the inking system may be modified such that two slits for permitting the two printing wire groups to respectively extend through the slits are formed in the lower end portion of the capillary path member corresponding to the locations of the two printing wire groups and three protrusions as the pressing means are provided for urging three divided portions of the lower end portion of the capillary path member formed by the two slits, against the rear surface of the bearing plate.

BRIEF DESCRIPTION OF THE DRAWINGS

Embodiments of the present invention are diagrammatically illustrated by the accompanying drawings in which.

DETAILED DESCRIPTION OF THE PREFERRED EMBODIMENTS

Figure 1:
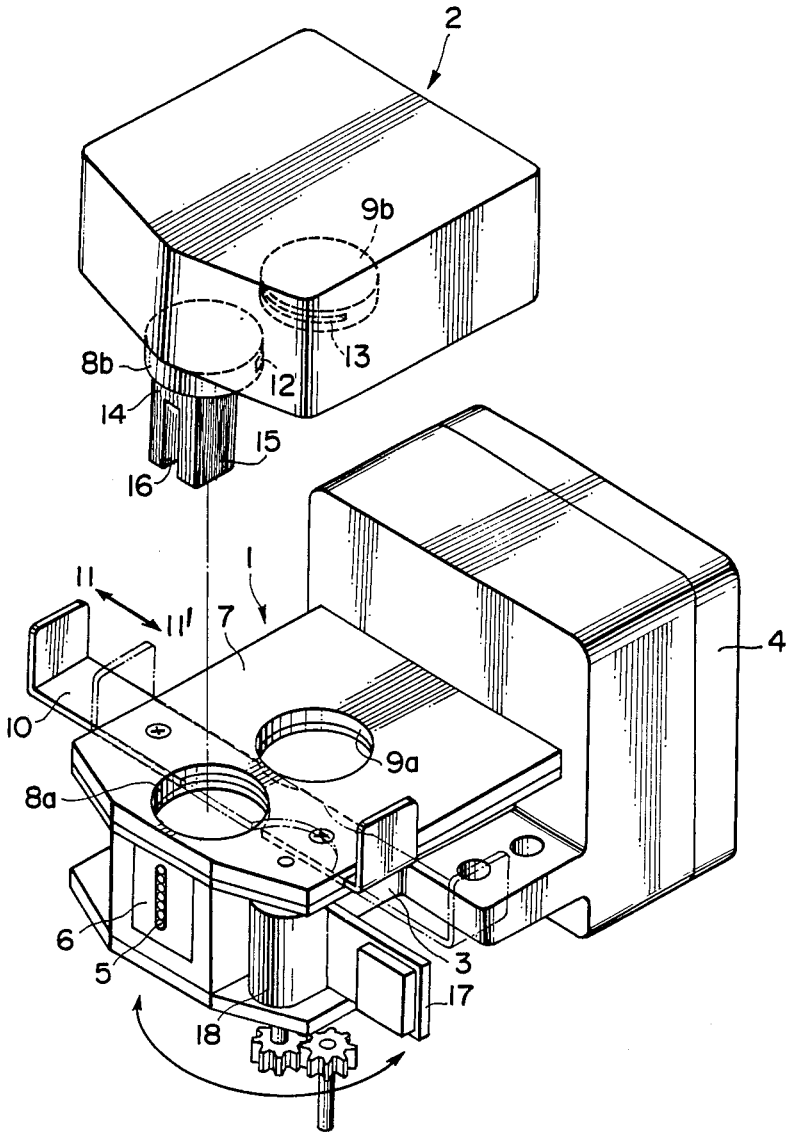
FIG. 1 is a perspective view showing an inking system for a wire dot matrix printer according to the present invention, in the condition that an interchangeable ink vessel, which is a constituent component of the system, is separated.

Referring to FIG. 1, there is shown a wire dot matrix printer head 1 which mounts thereon an interchangeable ink vessel 2. The printer head 1 has a housing 3 for carrying at the rear portion thereof an actuator unit 4. The housing 3 is provided with a bearing plate 6 at the front portion for slidably supporting printing wires 5 operatively connected to the actuator unit 4. The actuator unit 4 is well known and may be, for example, such an actuator unit as shown in U.S. Pat. No. 4,225,250.

Figure 2:
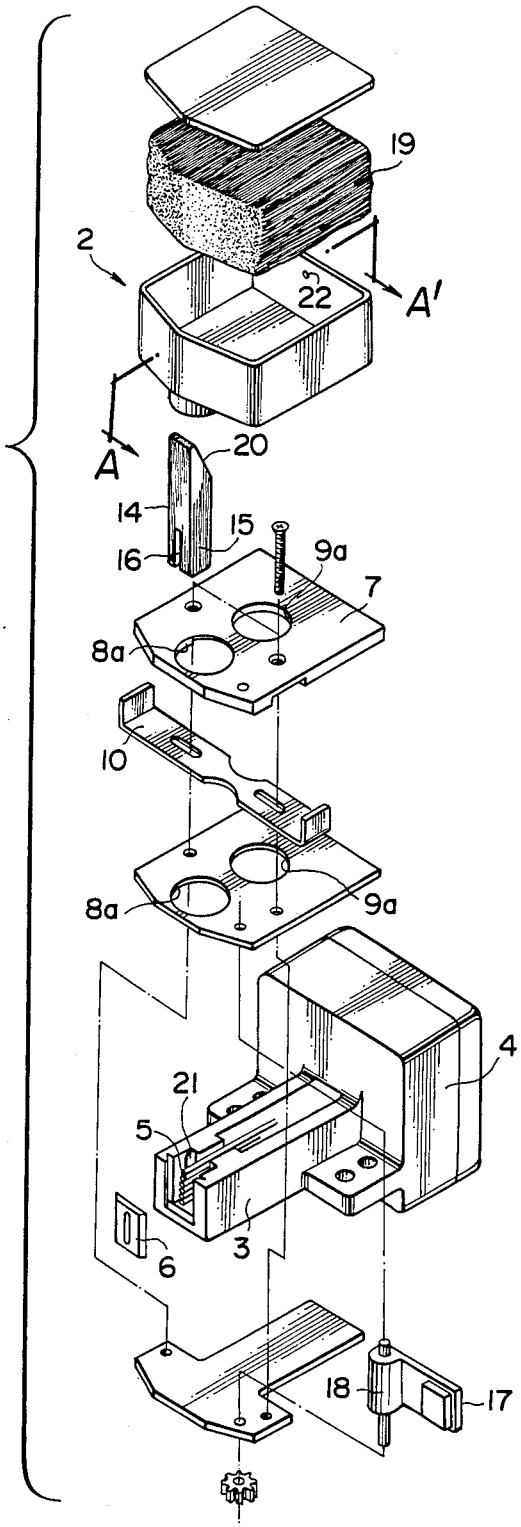
FIG. 2 is a perspective view showing the inking system of FIG. 1, in the condition as exploded into assembling parts thereof.
Figure 2A:
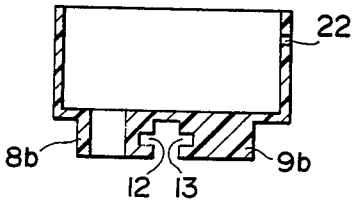
FIG. 2*a* is a sectional view of a casing body of the ink vessel of FIG. 2, taken on the line A—A′ of FIG. 2.

The construction of the inking system according to the present invention will be described with reference to FIGS. 1, 2 and 2*a*. In an upper plate 7 of the housing 3, openings 8*a* and 9*a* are formed in positions just above the printing wires extended within the housing 3 for removably mounting the ink vessel 2 in position on the upper plate 7. Corresponding to those openings 8*a* and 9*a*, protrusions 8*b* and 9*b* to be inserted, respectively, into the openings 8*a* and 9*a* are fixed on the bottom outer surface of the ink vessel 2. An elongated lock plate 10 is attached on the rear surface of the upper plate 7 so as to be slidable perpendicularly to the direction of extension of the printing wires 5 crossing between the openings 8*a* and 9*a*. The lock plate 10 has cut-away portions formed at its opposite side edge portions in the vicinity of its longitudinal center so as to allow the protrusions 8*b* and 9*b* to be inserted into the openings 8*a* and 9*a* through the cut-away portions, respectively. On the other hand, grooves 12 and 13 are respectively formed in the protrusions 8*b* and 9*b* at their respective side portions confronting each other so as to make the lock plate 10 slidable through the grooves 12 and 13 at the respective opposite side portions other than the cut-away portions thereof from a position 11 to another position 11′ as shown in FIG. 1 after the ink vessel 2 has been mounted onto the upper plate 7. Namely, the protrusions 8*b* and 9*b* of the ink vessel 2 are respectively inserted into the openings 8*a* and 9*a* through the cut-away portions of the lock plate 10 located at the position 11, and then the lock plate 10 is slid from the position 11 to the position 11′ so as to insert the opposite side portions thereof into the grooves 12 and 13 to thereby lock the ink vessel 2 on the housing 3. To remove the ink vessel 2, on the contrary, the lock plate 10 is returned from the position 11′ to the position 11 and then the ink vessel 2 is pulled upward.

The ink vessel 2 is filled with an ink absorbent member 19. The ink vessel 2 is integrally provided with a capillary path member 14 so that the capillary path member 14 is extended through the bottom of the ink vessel 2 into the inside thereof and is extended downward from the bottom of the same. In this embodiment, the capillary path member 14 is provided so as to pass through the protrusion 8*b*. This structure is advantageous in that the capillary path member 14 can be firmly fixed to the ink vessel 2 without ink leakage. The ink absorbent member 19 holds liquid ink in an absorbed state. To make ink absorbed into the ink absorbent member 19, for example, as shown in FIG. 2, the ink absorbent member 19 is put into the ink vessel 2, an upper cover of the ink vessel is fixed, and then a predetermined amount of ink is injected by use of an air hole 22 formed in the upper rear portion of the vessel. The reason why the air hole 22 is provided in the ink vessel 2 has been described above. The capillary path member 14 is wet with ink at all times through the contact between the upper end portion 20 thereof and the ink absorbent member 19 containing absorbed ink. An opening in the form of a slit 16 is formed in the lower end portion of the capillary path member 14 such that when the ink vessel 2 is mounted onto the upper plate 7 of the housing 3 and locked thereon, the slit 16 is caused to come down from the upper side of the group of printing wires 5 extending within the housing 3 so as to cover the group of printing wires 5 to thereby cause the whole of the group of printing wires 5 to extend through the slit 16. As shown in FIG. 2, in the housing 3, there are provided a pair of pressing means 21 having respective cam surfaces for urging the fork-shaped downward projecting sections of the lower end portion 15 of the capillary path member 14 at the opposite sides of the slit 16 against the rear surface of the bearing plate 6 to provide forced contact therebetween. In the embodiment shown in FIGS. 1 and 2, there is provided a cover plate 17 rotatably supported by a rotary shaft 18 to pivotably cover the front surface of the bearing plate 6, for the purpose of prevention of evaporation of ink through the front surface of the bearing plate 6 during suspension of the printing operation and prevention of contamination of the bearing plate 6 or front printing ends 5*a* of the printing wires 5 with ink sludge produced by the evaporation of ink.

Figure 4:
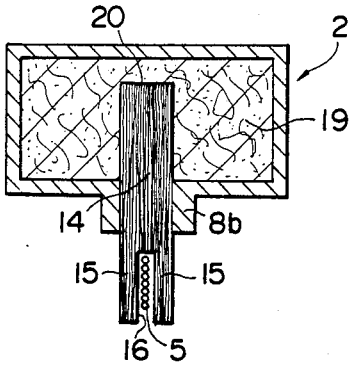
FIG. 4 is a partially sectional view along the line B—B′ of FIG. 3.
Figure 5:
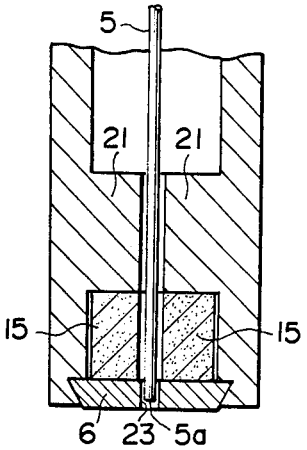
FIG. 5 is a partially sectional view along the line C—C′ of FIG. 3.
Figure 3:
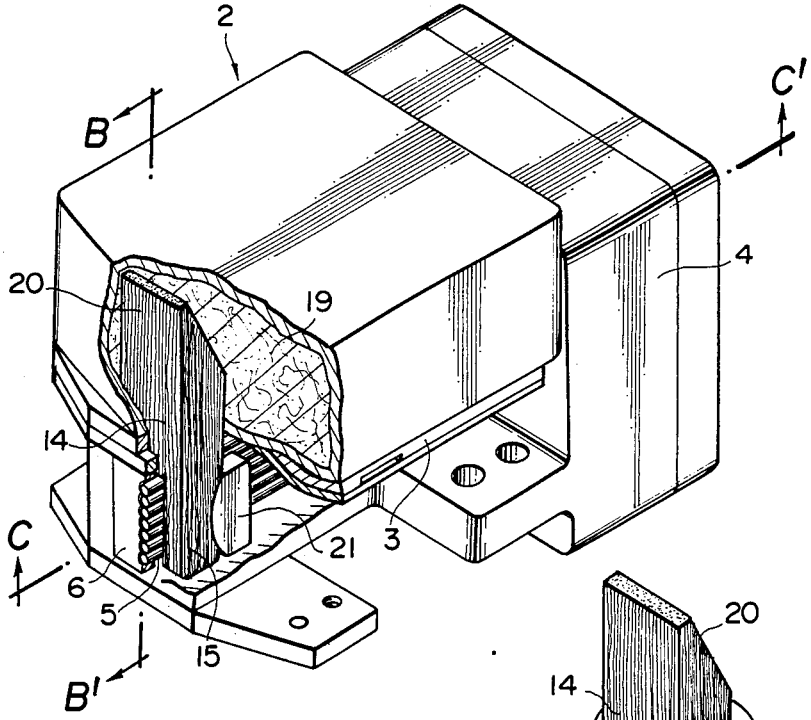
FIG. 3 is a partially cut-away perspective view of the inking system of FIG. 1, in the condition that the ink vessel is mounted on a nose portion of a printer head.

FIGS. 3, 4 and 5 show the mutual positional relationship among the capillary path member 14, the printing wires 5, the bearing plate 6, and the pressing means 21 when the ink vessel 2 has been mounted and locked on the upper plate 7 of the housing 3. The slit 16 formed in the lower end portion 15 of the capillary path member 14 has a width to provide a clearance large enough to substantially keep the inner surface of the slit 16 free from forced contact with the side surfaces of the printing wires 5 within the slit 16 under the condition that the lower end portion 15 is urged against the rear surface of the bearing plate 6 by the pressing means 21. It is of course allowable that fuzzy or small projections raised on the inner surface of the slit 16 may touch the printing wires 5 slightly. Accordingly, substantial supply of ink to the printing ends 5*a* of the printing wires 5 hardly depends on direct contact between the inner surface of the slit 16 and the respective printing wires 5. Ink absorbed in the lower end portion 15 is returned into the original liquid state (or so-called free liquid) on the rear surface of the bearing plate 6 by the pressing action of the pressing means 21. The liquid ink moves along the rear surface of the bearing plate 6 to bores 23 which are formed at the bearing plate 6 so as to slidably support the printing ends 5*a* of the printing wires 5. Thus, the printing ends 5*a* are wet with the liquid ink all times. In this embodiment, the pressing means 21 comprises a pair of protrusions projecting toward the bearing plate 6. In the above-described arrangement and functions, it is possible to supply the printing ends 5*a* with the liquid ink uniformly and surely without causing deterioration as well as abrasion in the lower end portion of the capillary path member 14 and with a reduced load onto the actuator unit 4 necessary for the reciprocating movement of the printing wires 5. In contrast, in the prior art inking system the ink supply to the printing wires is made by urging the ink absorbent member or capillary path member directly against the opposite side surfaces of the respective printing wires.

Figure 6:
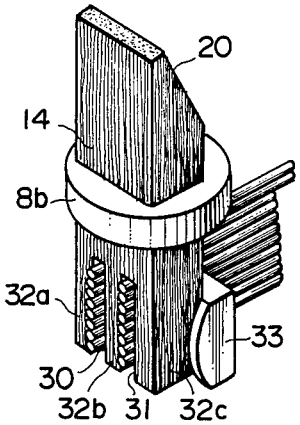
FIG. 6 is a perspective view of a modification of the capillary path member in the system according to the present invention.

The present invention is readily and easily applicable to the case where two groups or more of printing wires, each group being vertically aligned, are disposed within the housing 3. FIG. 6 is a perspective view of another embodiment showing the construction of the lower end portion of a capillary path member 14 when the invention is applied to the case where two printing wire groups are provided, and showing the arrangement relationship between the printing wires and pressing means 33. In this embodiment, the lower portion of the capillary path member 14 is divided into three downward projecting portions 32*a*, 32*b* and 32*c* to form two slits 30 and 31 therebetween respectively corresponding to the two groups of printing wires. The pressing means 33 comprises three protrusions disposed so as to urge the projecting portions 32*a*, 32*b* and 32*c* against the bearing plate 6, respectively.

According to the present invention, the ink absorbent member 19 and the capillary path member 14 perform important roles on proper ink supply to the printing wires 5. The porous ink absorbent member 19 has a large number of capillary micropores so as to keep the ink within the ink vessel 2 not in its original liquid state but in an absorbed state due to capillary attraction of the capillary micropores. This is a measure to counter the above-discussed various disadvantages caused when the ink is kept in its original liquid state within the ink vessel, in relation with the attachment of the ink vessel 2 on the upper portion of the housing 3 for the purpose of practicable structure and arrangement of the printer head (refer to the latter half of SUMMARY OF THE INVENTION). Absorbent cotton or sponge may be used as the ink absorbent member 19. These materials have a strong affinity for ink and swells by adsorption of ink. Namely, these materials are superior in an ink-holding or ink-retaining capacity. However, these materials may be unsuitable for rapid and appropriate supply of ink to the lower end portion of the capillary path member in immediate response to the consumption of ink during the printing operation. Therefore, as the ink absorbent member, suitable is a material having no strong affinity for ink while having a wettability with ink, so that the material can merely physically absorb ink into the capillary micropores to hold or retain the same therein by the capillary attraction. Preferably, the material having such a property is used in the form of a fiber. More preferably, synthetic fibers, especially polyester fibers or acrylic fibers, are used. Because of the fibrous nature, the bulk factor of the fiber bulk within the ink vessel can be suitably adjusted by adjusting the amount of the fiber charged into the ink vessel. Accordingly, the mean size of the capillary micropores (which, in this case, are a large number of micropores formed by intertwinement of a large number of single fibers) can be adjusted, so that the ink-absorbing-and-holding capability can be experimentally selected to fall within a necessary range in relative comparison with the capillary path member 14.

Here, the term "bulk factor" is defined as the ratio of the apparent volume of a substance having a large number of pores to the true volume of the same substance (that is, the value obtained by dividing the mass of the substance by the true density thereof). With respect to the above-mentioned fibers, the bulk factor is represented by the ratio of the interior volume of the ink vessel 2 to the true volume of the fiber charged therein, because the ink vessel 2 is filled up with the fiber by the bulking power of the fiber.

For the above-mentioned reasons, the amount of ink to be injected into the ink vessel 2 should be within a range less than the limit of the ink-absorbing-and-holding capacity of the ink absorbent member or, in other words, should be within a range in which ink substantially cannot exist in its original liquid state on the bottom of the ink vessel.

As the porous capillary path member 14, suitable may be a fiber which is adhering-processed with a resin so as to have a fixed form while leaving the large number of capillary micropores. Preferably, synthetic fibers, especially polyester fibers or acrylic fibers, are used. For example, a bundle of or a knitted or woven fabric of an acrylic fiber is impregnated with a suitable amount of melamine-formaldehyde resin and cured so as to obtain a composite in a desired form.

It is preferable that the bulk factor of the capillary path member 14 is selected to be less than that of the ink absorbent member 19. Namely, the mean size of the capillary micropores formed within the capillary path member 14 is made to be smaller than that of the ink absorbent member 19, so as to make the ink-absorbing-and-holding capability of the capillary path member 14 larger than that of the ink absorbent member 19, so that the ink absorbed in the ink absorbent member 19 is automatically rapidly and appropriately supplied to the lower end portion 15 in response to the consumption of the ink during the printing operation. In addition, a preferred numerical relationship between those bulk factors depends on the respective materials of the capillary path member 14 and the ink absorbent member 19, the surface tension and viscosity of the printing ink, etc.

The following example illustrates the technical matters described above with respect to the ink absorbent member 19 and the capillary path member 14.

Printing liquid ink having the surface tension of 42 dyn/cm or less and viscosity of 2.7 cp or less, at the room temperature, was used. A carded staple of a polyester or acrylic fiber was used as the ink absorbent member 19. As the capillary path member 14, a bandle of an acrylic fiber was impregnated with a liquid addition-condensation product of melamine and formaldehyde, and then cured to obtain a molding having a bulk factor of about 250%. The ink vessel 2 having an interior volume of 10 $cm^3$ was filled with the carded staple of the true volume of about 2 $cm^3$. In short, the bulk factor of the staple within the ink vessel was about 500% ($100\% \times 10\ cm^3/2\ cm^3$). About 6.4 $cm^3$ of the liquid ink which corresponds to 80% of the substantially empty space volume of the ink vessel or in other words about 80% of 8 $cm^3$, was injected into the ink vessel. When the ink vessel was mounted on the housing of the printer head and locked thereto, the ink was held by both the ink vessel and the capillary path member without outflow of the ink from the lower end portion of the capillary path member during suspension of the printer operation. Furthermore, during printing operation, the ink was smoothly supplied to the respective printing wires in response to the consumption of ink owing to the printing operation. Namely, the uniform and sharp dot-printing was ensured.

What is claimed is:

1. An inking system for a wire dot matrix printer comprising a plurality of printing wires operably connected at their respective one ends to an actuator unit; a housing disposed on a front end of the actuator unit for accommodating the printing wires therein; a bearing plate disposed at a front end of the housing and having therein bores for slidably supporting the respective other ends of the printing wires; an ink vessel for reserving ink therein; a capillary path member for passing ink therethrough, the capillary path member having an upper portion extending upward into the ink vessel and a lower portion thereof extending downward from the bottom of the ink vessel; and connecting means for removably connecting the ink vessel with the housing, the improvement wherein:

the ink vessel accommodates therein an ink absorbent member impregnated with ink, the maximum amount of the ink within the ink vessel relative to the ink absorbent member being limited to be less than an ink-absorbing and holding capacity of the ink absorbent member such that the ink vessel substantially always leaves no ink in its original free liquid state;

the capillary path member comprises a porous composite material having a lower bulk factor in dry state than that of the ink absorbent member in dry state and has at least one slit open at a free end of the lower portion of the capillary path member for passing the printing wires through the slit, the slit having a sufficient size relative to the printing wires so that the printing wires do not make frictional contact with the lower end portion of the capillary path member;

the housing has an opening in an upper surface thereof for receiving the lower portion of the capillary path member into the housing, and has pressing means fixed within the housing and having at least two urging surfaces for pressing the lower end portion of the capillary path member against the bearing plate to enable the ink absorbed in the lower end portion of the capillary path member to be transferred through the bearing plate bores to the printing wires; and the connecting means detachably fixes the ink vessel provided with the capillary path member onto the upper surface of the housing such that the slit surrounds the printing wires while substantially preventing the forced contact between the printing wires and the lower end portion of the capillary path member.

2. An inking system according to claim 1; in which the ink absorbent member in the ink vessel comprises one of a polyester fiber and an acrylic fiber, and the porous composite material of the capillary path member is composed of an acrylic fiber and a melamine-formaldehyde resin.

3. An inking system according to claim 1; in which the pressing means comprises at least two protrusions each projecting toward the bearing plate along either side of the printing wires.

4. An inking system according to claim 1; in which the ink vessel has an air hole formed in a wall of the ink vessel for permitting air to pass freely therethrough.

5. An inking system according to claim 1; in which the connecting means comprises two protrusions which are projected apart from each other and downwardly from the bottom outer surface of the ink vessel, and two openings which are formed in the upper surface of the housing, the two openings being shaped and arranged so as to fittingly receive the two protrusions, respectively.

6. An inking system according to claim 5; in which the connecting means further comprises locking means for detachably locking the two protrusions in the two openings, the locking means comprising an elongated lock plate which is attached to a rear surface of an upper plate of the housing between the two openings of the housing so as to slidably move along the rear surface and across the printing wires, and a pair of grooves which are formed in the respective opposed side portions of the two protrusions of the connecting means so that the grooves face each other and extend in parallel with the sliding direction of the lock plate, the two grooves being shaped and arranged so as to fittingly receive opposite longitudinal edge portions of the lock plate, respectively.

7. An inking system according to claim 1; in which the printing wires are arranged in two groups separated from each other at a distance, the lower end portion of the capillary path member is forked into three downwardly projecting portions to thereby form two slits corresponding to the two groups of the printing wires, and the pressing means comprises three protrusions which are projected toward the bearing plate so as to press the three downwardly projecting portions, respectively, of the lower end portion of the capillary path member against the bearing plate.

8. An inking system according to claim 1; further comprising covering means rotatably attached to the front end of the housing for removably covering a front surface of the bearing plate to thereby prevent evaporation of ink from the bearing plate during suspension of the printer operation.

9. An inking system for a wire dot matrix printer comprising a plurality of printing wires operably connected at their respective one ends to an actuator unit; a housing disposed on a front end of the actuator unit for accommodating the printing wires therein; a bearing plate disposed at a front end of the housing and having therein bores for slidably supporting the respective other ends of the printing wires; an ink vessel for reserving ink therein; a capillary path member for passing ink therethrough, the capillary path member having an upper portion extending upward into the ink vessel and a lower portion thereof extending downward from the bottom of the ink vessel; and connecting means for removably connecting the ink vessel with the housing, the improvement wherein the ink vessel accommodates therein a synthetic fiber impregnated with ink, the maximum amount of the ink within the ink vessel relative to the synthetic fiber being limited to be less than an ink-absorbing and holding capacity of the synthetic fiber such that the ink vessel substantially always leaves no ink in its original free liquid state;

the capillary path member comprises a porous composite material composed of a synthetic fiber and a resin and having a lower bulk factor in dry state than that of the synthetic fiber in dry state in the ink vessel and has at least one slit open at a free end of the lower portion of the capillary path member for passing the printing wires through the slit, the slit having a sufficient size relative to the printing wires so that the printing wires do not make frictional contact with the lower end portion of the capillary path member;

the housing has an openingin an upper surface thereof for receiving the lower portion of the capillary path member into the housing, and pressing means comprised of at least two protrusions fixed within the housing, which are projected toward the bearing plate and along the printing wires, for pressing the lower end portion of the capillary path member against the bearing plate to enable the ink absorbed in the lower end portion of the capillary path member to be transferred through the bearing plate bores to the printing wires; and the connecting means detachably fixes the ink vessel provided with the capillary path member onto the upper surface of the housing such that the slit surrounds the printing wires while substantially preventing the forced contact between the printing wires and the lower end portion of the capillary path member.

10. An inking system according to claim 9; in which the synthetic fiber in the ink vessel comprises one of a polyester fiber and an acrylic fiber, and the porous composite material of the capillary path member is composed of an acrylic fiber and a melamine-formaldehyde resin.

11. An inking system according to claim 9; in which the ink vessel has an air hole formed in a wall of the ink vessel for permitting air to pass freely therethrough.

12. An inking system according to claim 9; in which the connecting means comprises two protrusions which are projected apart from each other and downwardly from the bottom outer surface of the ink vessel, and two openings which are formed in the upper surface of the housing, the two openings being shaped and arranged so as to fittingly receive the two protrusions, respectively.

13. An inking system according to claim 12; in which the connecting means further comprises locking means for detachably locking the two protrusions in the two openings, the locking means comprising an elongated lock plate which is attached to a rear surface of an upper plate of the housing between the two openings of the housing so as to slidably move along the rear surface and across the printing wires, and a pair of grooves which are formed in the respective opposed side portions of the two protrusions of the connecting means so that the grooves face each other and extend in parallel with the sliding direction of the lock plate, the two grooves being shaped and arranged so as to fittingly receive opposite longitudinal edge portions of the lock plate, respectively.

14. An inking system according to claim 9; in which the printing wires are arranged in two groups separated from each other at a distance, the lower end portion of the capillary path member is forked into three downwardly projecting portions to thereby form two slits corresponding to the two groups of the printing wires, and the pressing means comprises three protrusions which are projected toward the bearing plate so as to press the three downwardly projecting portions, respectively, of the lower end portion of the capillary path member against the bearing plate.

15. An inking system according to claim 9; further comprising covering means rotatably attached to the front end of the housing for removably covering a front surface of the bearing plate to thereby prevent evaporation of ink from the bearing plate during suspension of the printer operation.

16. In a wire dot printer including a housing having front and rear portions, a plurality of printing wires having respective front and rear end portions and extending through the housing between the housing front and rear portions, actuating means disposed in the housing rear portion and connected to the respective rear end portions of the printing wires for selectively actuating the printing wires in the longitudinal direction thereof, and a bearing plate disposed in the housing front portion and having means defining bores for slideably receiving the respective front end portions of the printing wires to supply thereto liquid ink during the actuation of the printing wires: an ink vessel disposed on the housing and containing therein a first porous member having capillary pores of relatively large size for retaining therein liquid ink; a second longitudinal porous member having an upper end portion extending upwardly into the ink vessel in contact with the first porous member and a lower end portion extending downwardly into the housing front portion in contact with the bearing plate, the lower end portion having means defining an opening for passing therethrough the printing wires, the second porous member having capillary pores of relatively small size for transferring the liquid ink retained in the first porous member through the upper end portion to the lower end portion to thereby retain the transferred liquid ink in the lower end portion; and pressing means opposed to the bearing plate with respect to the lower end portion of the second porous member for pressing the lower end portion against the bearing plate to thereby transfer the liquid ink retained in the lower end portion to the bearing plate bores at which the liquid ink is supplied to the printing wire front end portions.

17. A wire dot printer according to claim 16; wherein the first porous member has a relatively great bulk factor and the second porous member has a relatively small bulk factor.

18. A wire dot printer according to claim 17; wherein the first porous member is comprised of a bulk of synthetic fiber.

19. A wire dot printer according to claim 18; wherein the synthetic fiber is selected from the group consisting of polyester fiber and acrylic fiber.

20. A wire dot printer according to claim 17; wherein the second porous member is composed of porous composite material.

21. A wire dot printer according to claim 20; wherein the porous composite material is composed of synthetic fiber and resin.

22. A wire dot printer according to claim 21; wherein the synthetic fiber comprises acrylic fiber and the resin comprises melamine-formaldehyde resin.

23. A wire dot printer according to claim 16; wherein the ink vessel includes means defining the maximum amount of liquid ink to be stored therein below an ink-retaining capacity of the first porous member.

24. A wire dot printer according to claim 16; wherein the ink vessel has an air hole for permitting air to pass freely therethrough.

25. A wire dot printer according to claim 16; wherein the lower end portion of the second porous member has a pair of end sections extending downwardly in spaced relation to each other to define therebetween a slit opening for passing linearly aligned printing wires.

26. A wire dot printer according to claim 16; wherein the lower end portion of the second porous member has three end sections extending downwardly in spaced relation to one another to define therebetween a pair of slit openings for passing a pair of linearly aligned printing wires.

27. A wire dot printer according to claim 25; wherein the pressing means has a pair of protrusions protruding toward the bearing plate for pressing respective end sections against the bearing plate.

28. A wire dot printer according to claim 16; including attaching means for detachably attaching the ink vessel to the housing.

29. A wire dot printer according to claim 28; wherein the attaching means includes a pair of protrusions protruding downwardly from the ink vessel in spaced relation to each other, one of the protrusions having a hollow for mounting therein the the upper portion of the record porous member, a pair of openings provided in an upper portion of the housing in spaced relation to each other for receiving therein the respective protrusions, one of the openings receiving therethrough the lower portion of the second porous member, and locking means for locking the protrusions in the openings.

30. A wire dot printer according to claim 29; wherein the locking means comprises a pair of grooves formed in the respective protrusions in opposed relation to each other, and a locking plate slideably mounted on the upper portion of the housing between the pair of openings so that the locking plate engages with the grooves when the pair of protrusions are received in the pair of openings.

31. A wire dot printer according to claim 16; including covering means removably mounted on the housing front end for covering the bearing plate during the suspension of the printer operation to thereby prevent evaporation of the liquid ink from the bearing plate bores.

* * * * *